United States Patent [19]

Temme

[11] Patent Number: 4,937,981

[45] Date of Patent: Jul. 3, 1990

[54] CENTRIFUGAL-FORCE VIBRATORY GRINDING MACHINE

[75] Inventor: Karl Temme, Wuppertal, Fed. Rep. of Germany

[73] Assignee: Carl Kurt Walther GmbH & Co. KG, Wuppertal, Fed. Rep. of Germany

[21] Appl. No.: 287,770

[22] Filed: Dec. 19, 1988

[30] Foreign Application Priority Data

Dec. 19, 1987 [DE] Fed. Rep. of Germany ..... 3743161

[51] Int. Cl.[5] ..... B24B 31/10

[52] U.S. Cl. ..... 51/7; 51/17; 51/164.1

[58] Field of Search ..... 51/7, 163.1, 163.2, 51/164.1, 313, 17; 241/170, 171, 172, 173, 174, 179

[56] References Cited

U.S. PATENT DOCUMENTS

| | | | |
|---|---|---|---|
| 3,030,746 | 4/1962 | Firestine et al. | 51/313 X |
| 3,861,086 | 1/1975 | Dreher | 51/164.1 |
| 4,096,666 | 6/1978 | Brown | 51/164.1 X |
| 4,551,949 | 11/1985 | Akhavi et al. | 51/164.1 |
| 4,620,394 | 11/1986 | Temme et al. | 51/163.2 |
| 4,709,507 | 12/1987 | Musschoot | 51/17 X |

FOREIGN PATENT DOCUMENTS

| | | | |
|---|---|---|---|
| 3228658 | 2/1984 | Fed. Rep. of Germany . | |
| 99069 | 5/1987 | Japan | 51/163.2 |
| 580099 | 11/1977 | U.S.S.R. | 51/163.2 |
| 861027 | 9/1981 | U.S.S.R. | 51/164.1 |

*Primary Examiner*—Robert P. Olszewski
*Attorney, Agent, or Firm*—Martin A. Farber

[57] ABSTRACT

The present invention relates to a centrifugal-force vibratory grinding machine with stationary container having a filling opening and rotary plate rotating relative thereto for the revolving of the content of the container. In order to obtain high overall efficiency, it proposes, in particular, that the container (4) which extends horizontally with the filling opening (27) on its circumferential wall is closed at both ends and that at least one of the two closure walls forms the rotary plate (5, 6).

11 Claims, 6 Drawing Sheets

CENTRIFUGAL-FORCE VIBRATORY GRINDING MACHINE

FIELD AND BACKGROUND OF THE INVENTION

The present invention relates to a centrifugal-force vibratory grinding machine with stationary container having a filling opening and rotary plate rotating relative thereto for the revolving of the contents of the container.

A vibratory grinding machine of this type is known from Federal Republic of Germany OS 3,228,658, in which the container is of pot shape with vertically directed pot wall extending parallel to the axis of the rotary plate. When the centrifugal-force vibratory grinding machine is in operation, an annular bead which carries out a helical movement is produced in the container by the rotating rotary plate, and during this movement the grinding bodies effect a surface treatment of the work pieces. The filling and emptying of the container is effected through the mouth of the pot. For filling, the container must assume its vertical position, with the mouth of the pot directed upward. The emptying is effected by swinging the container, the entire container being tipped with a simultaneous change in the position of inclination of the rotary plate.

SUMMARY OF THE INVENTION

The object of the invention is so to develop a centrifugal-force vibratory grinding machine of the type in question in that the overall efficiency is increased and in a manner which is simple to manufacture.

This object is achieved in a centrifugal-force vibratory grinding machine of the foregoing type wherein a container (4), which extends horizontally and has the filling opening (27) on its circumferential wall, is closed at both ends and that at least one of the two closure walls forms the rotary plate (5,6).

As a result of this development, a centrifugal-force vibratory grinding machine of foregoing type is created which is characterized by increased overall efficiency. This refers, on the one hand, to the grinding output and, on the other hand, to particularly short loading and unloading times, with an increase in the economy of the centrifugal-force vibratory grinding machine. It has been found that horizontal arrangement of the container which is closed at both ends results in increased output, as a result of which the time of stay of the content of the containers—i.e., the work pieces and abrasive bodies—within the container can be reduced. It is clear that the degree of filling of the container is so great that the content of the container is acted on well by the rotary plate, which imparts a corresponding rotation to the content of the container.

One advantageous feature resides in the fact that the container is of circular cross section. This assures good rotation. The wall of the container can either be aligned parallel to the longitudinal axis of the container or be barreled.

One possibility for emptying the container in a short time consists in the provision of a closable emptying opening in the lower region of the surrounding wall of a container. The corresponding closure element can be a flap or slide. After a suitable time of stay of the content of the container, the closure element is moved into the open position so that the content of the container leaves the container as a result of gravity. An alternative manner of operation is possible by fastening the work pieces which are to be worked to work piece holders and immersing them through the filling opening into a working agent. After the surface treatment, the work pieces leave the container over the same path.

For a short time of loading and emptying of the container, the container may be mounted for turning around a central, substantially horizontal axis. The corresponding positions of the container can be produced with little expense for drive.

In this connection, it is advantageous for the rotatably mounted container to assume its filling and operating position with the filling opening facing upward and for the container to be so turned in the emptying position of the container that the filling opening faces downward. The loading is accordingly effected with the filling opening facing upward. After a suitable short time of stay of the content of the container, the container then need merely be turned 180° so that the emptying takes place in downward direction.

The working efficiency can be further increased by developing both closure walls as rotary plates. Therefore, from both sides of the container, impulses which lead to a particularly high grinding output are exerted on the content of the container.

Variations with respect to the grinding output can be obtained in the manner that the rotary plates are driven in the same direction or in directions opposite to each other.

This can take place either with the same or different speed of rotation.

Another advantage resides in the fact that the circumferential edge of the rotary plate engages in the container in such a manner that a gap formed between these two parts extends diverging towards the center of the container at a slight angle to the axis of the rotary plate. As a result of the centrifugal force which occurs when the rotary plate rotates, treatment liquid which has possibly been added to the content of the container is therefore directed toward the inside of the container.

In addition to this, it has been found favorable for a treatment-agent feed opening to be arranged close to the filling opening, seen in the circumferential direction of the container. In this way, the treatment liquid can also be added, at the same time as the loading of the container, achieving a short total time of loading.

Finally, it is advantageous, from the standpoint of loading and unloading, for the filling opening to extend substantially over the entire length of the container. This proves particularly favorable upon the emptying of the container, since complete removal of the content of the container is obtained when the filling opening points downward.

BRIEF DESCRIPTION OF THE DRAWINGS

With the above and other objects and advantages in view, the present invention will become more clearly understood in connection with the detailed description of a preferred embodiment, when considered with the accompanying drawings, of which.

One embodiment of the invention will be explained below with reference to FIGS. 1 to 7, in which.

DETAILED DESCRIPTION OF THE PREFERRED EMBODIMENT

Figure 1:
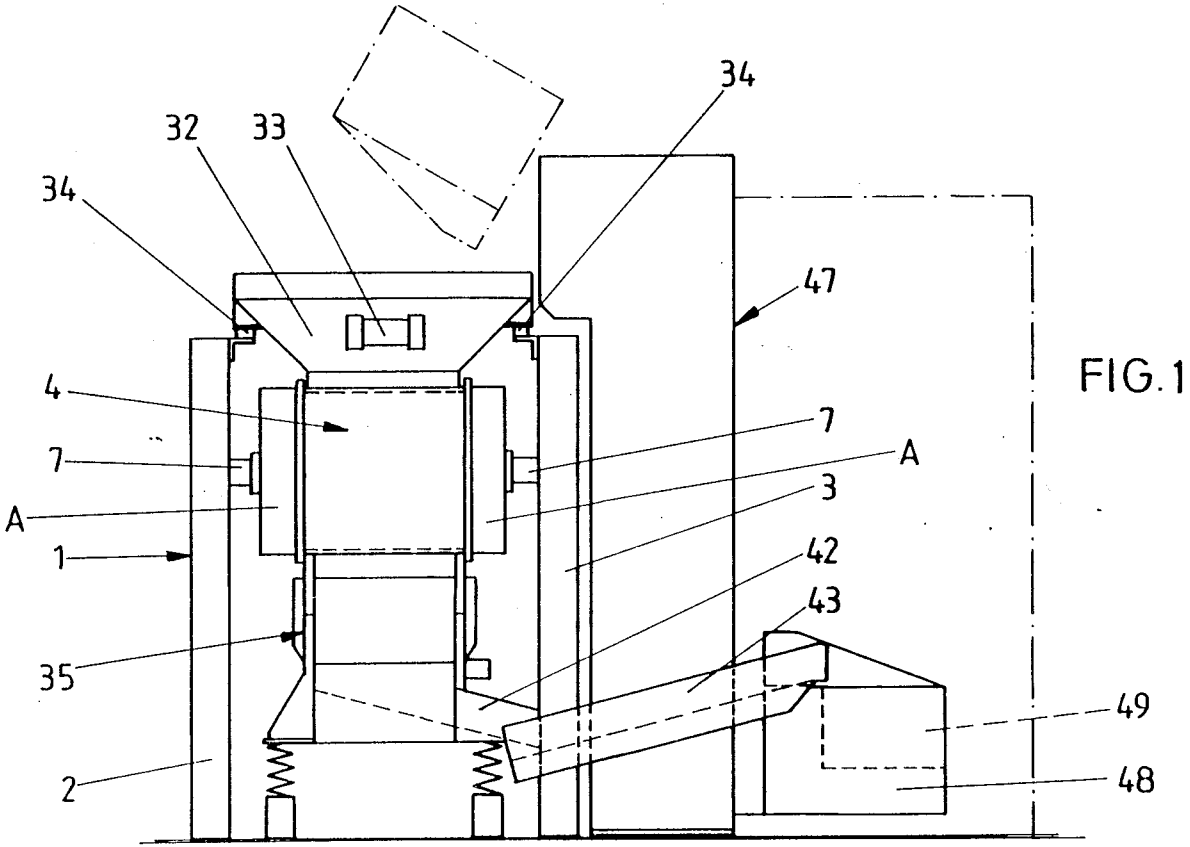
FIG. 1 shows in elevation a centrifugal-force vibratory grinding machine used as part of a vibratory grinding installation.

The centrifugal-force vibratory grinding machine, designated generally as 1, has two vertically aligned side palates 2, 3 arranged parallel to each other which, in their upper region, receive a container 4, which extends horizontally. The container has a circular cross-section and is of cylindrical shape. The container is closed on its two ends. The two corresponding closure walls are developed as rotary plates 5, 6. Each rotary plate 5, 6 is seated fixed for rotation on a shaft 7 which terminates in the base 8 of the plate. This means that there is no continuous shaft which extends through the container. The base 8 of the plate extends at right angles to the shaft 7 of the rotary plate and passes via a curved section 9 into a plate rim 10 which is so inclined to the shaft 7 of the rotary plate that the plate rim 10 rises in the direction towards the inside of the container. The rotary plate 5, 6 itself consists of resistent material such as, for instance, polyurethane. In order to make it flexurally stable, inserts 11 can be provided in it.

Figure 5:
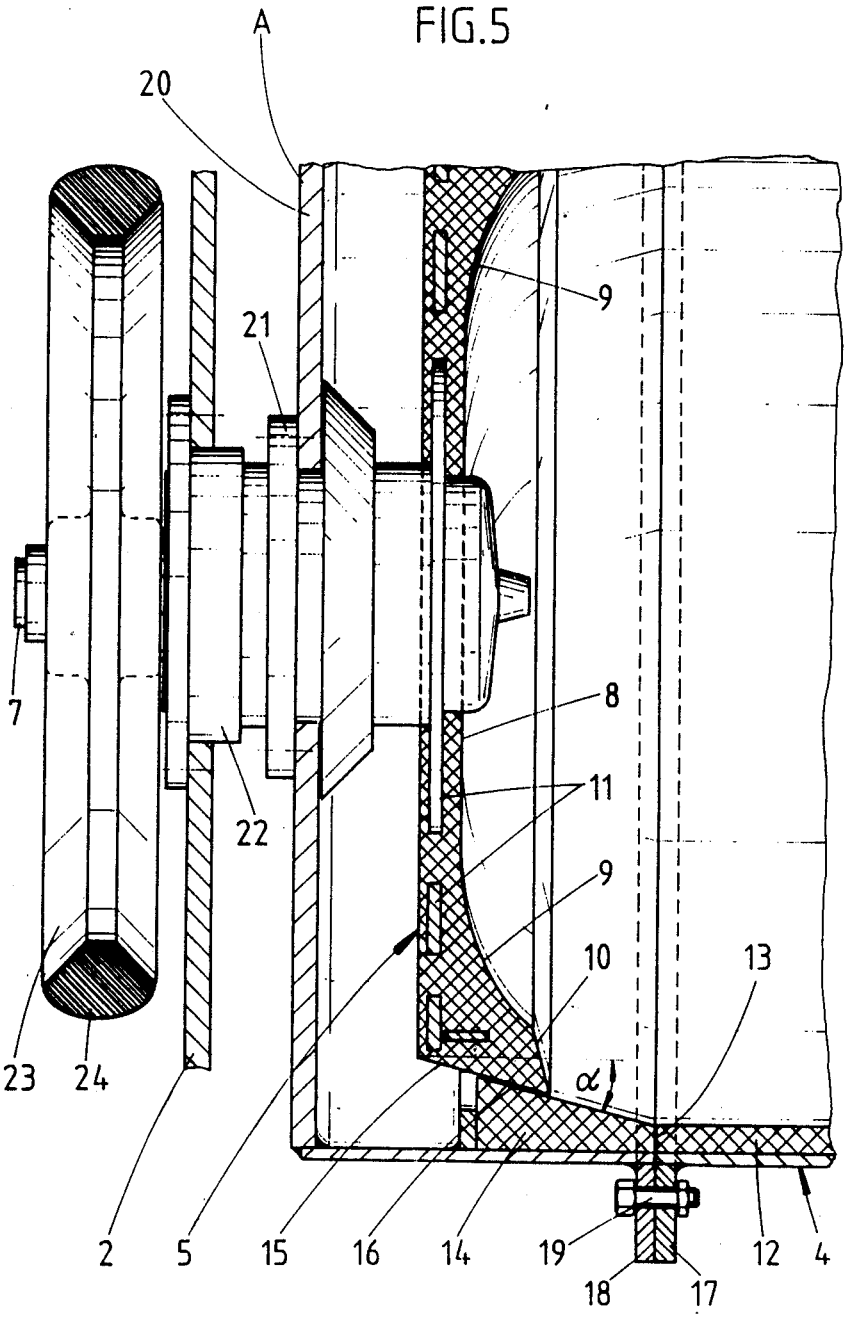
FIG. 5 is a partial longitudinal section in the region of the one end of the container.

The container 4 is provided with an abrasion-resistant plastic lining 12 which continues on the other side of end container separating places 13 in conically widening lining sections 14. The circumferential edge 15 of the plate 5, 6 extends into each lining section 14 which forms part of the inner wall of the container in such a manner that gap 16 formed between the rotary plate 5, 6 and the container extends diverging toward the inside of the container at a slight angle to the shaft 7 of the rotary plate. The corresponding angle alpha shown in FIG. 5 is between about 10° and 30°.

In the region of each separation place 13, the container 4 is provided with two abutting flanges 17, 18, which are passed through by attachment screws 19. The section A of the container 4 which bears the flange 18 is of pot shape. At the height of the rim of the pot of section A there extends the lining section 14. The bottom 20 of the pot is passed through by the rotary-plate shaft 7 and contains a bearing 21 for the passage of the shaft 7 of the rotary plate. The bearing 21, on its part, is rotatably seated in a supporting bearing 22 of the side plate 2 and 3 respectively. In this way, it is possible for the rotary plate 5, 6 to rotate while the container 4 remains in a position of rest.

The free ends of the rotary plate shafts 7 are provided with pulleys 23 which can be driven by V-belts 24 via electric motors 25, 26. The rotary plates can be driven in simple manner in the same or opposite directions.

The pot-shaped sections A which bear the bearings 21 and thus also serve for the mounting of the rotary plates 5, 6 are developed identical to each other, which contributes to simplicity in manufacture. They can, for instance, be used for containers 4 of different length.

Figure 6:
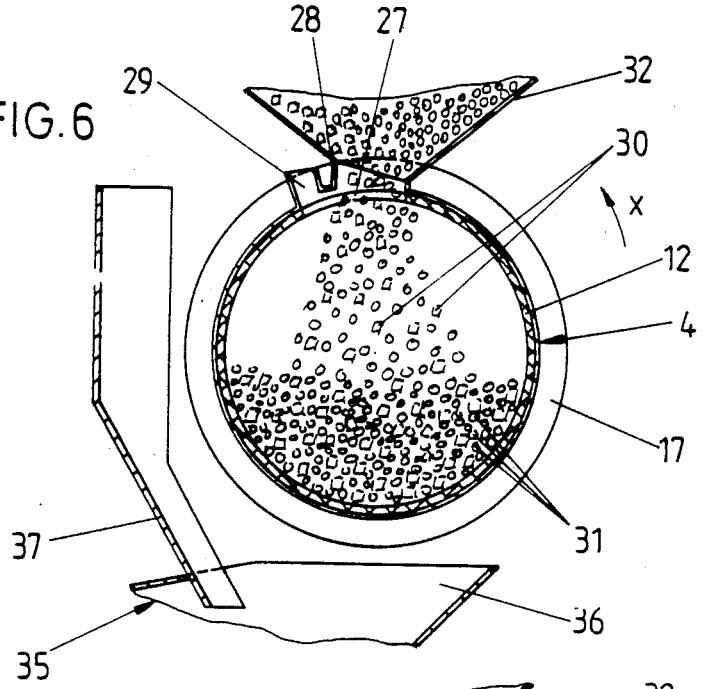
FIG. 6 is a cross-section through the container in its filled position.

The horizontally extending container 4 is provided, in the region between the two inner flanges 17 on the circumferential wall, with a filling opening 27 which extends substantially over the entire length of the container 4. The filling opening, which is substantially rectangular in contour, is flanked on the edge side by an outward directed collar 28. In the filling or operating position of the container 4, the filling opening 27 faces upward. In the emptying position of the container, the container 4 is then turned in such a way that the filling opening 27 faces downward. This means that, for this purpose, the container is turned about 180°. The direction of turning is indicated by the arrow X in FIG. 6.

In accordance with an embodiment which has not been shown in the drawing, the turning of the container can be dispensed with for the emptying of it. For this purpose, the container is so developed that it has a closable emptying opening in the lower region of its circumferential wall.

A treatment-agent feed opening 29 is arranged adjacent to the filling opening 27, as seen in the circumferential direction of the container. It can also preferably extend over the length of the container 4 and serves for the addition of liquid treatment agent.

The content of the container, consisting of work pieces 30 and abrasive members 31, is fed to the container via a supply container 32. This means that the supply container 32 must be arranged above the container 4. For this purpose, the supply container 32 is fastened in the upper region of side plates 2, 3. The supply container 32 tapers downward to form a hopper which can be closed at its lower end and which can be brought into an alignment with the filling opening 27. The emptying of the supply container 32 is favored by a vibration generator 33. For this purpose, the storage container 32 rests on spring elements 34 of the side plates 2, 3. The amount of abrasive members 31 and work pieces 30 which can be removed from the supply container 32 corresponds approximately to one load of the container 4.

Below the container 4 there is a screening device 35 the inlet opening 36 of which has, associated with it, an inclined baffle plate 37 which, upon the turning of the container 4 into the emptying position, directs the content of the container in the direction towards the inlet opening 36.

Figure 2:
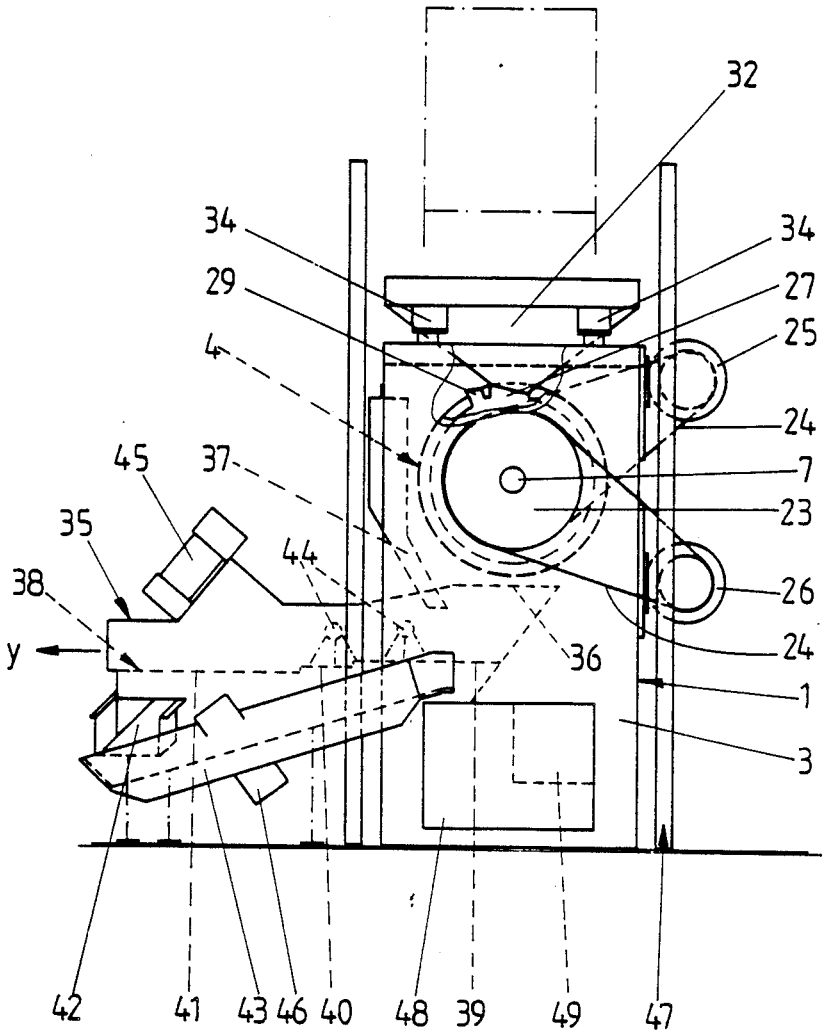
FIG. 2 is a rear view of FIG. 1.
Figure 3:
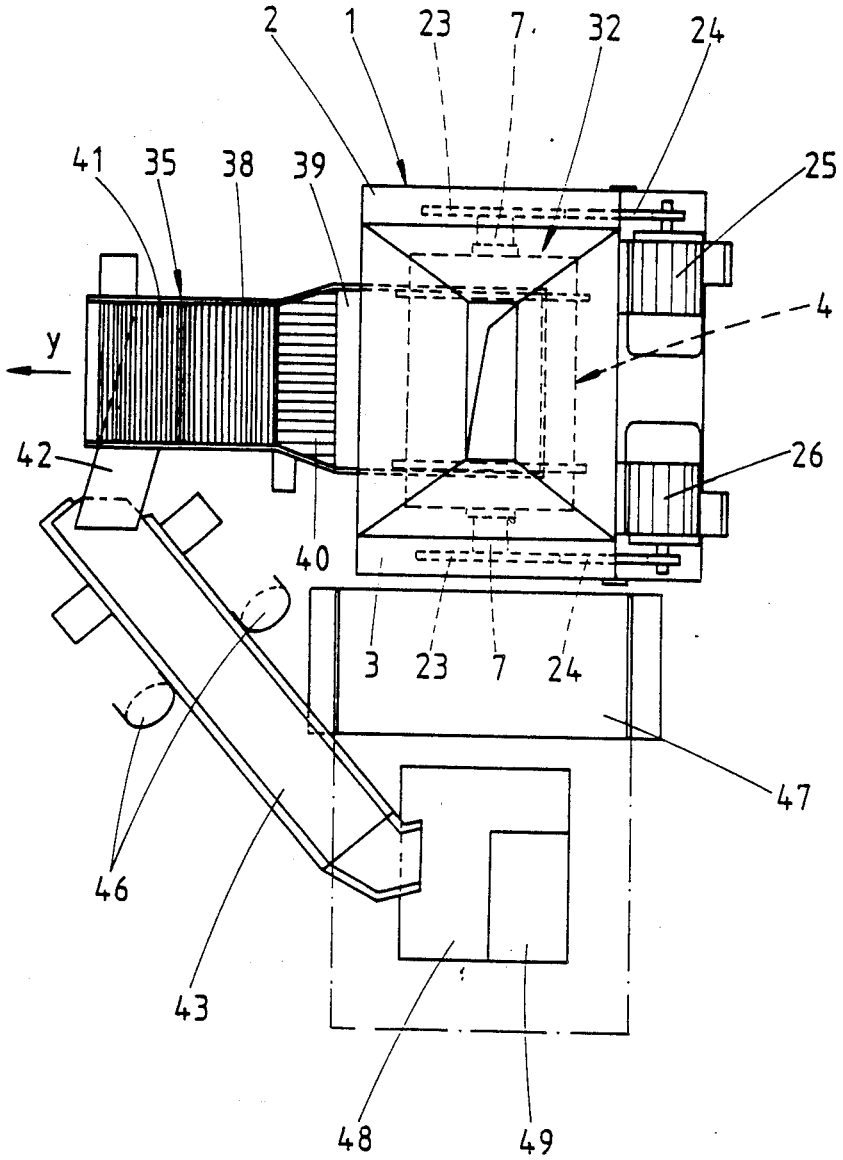
FIG. 3 is a top view of the vibratory grinding installation.
Figure 4:
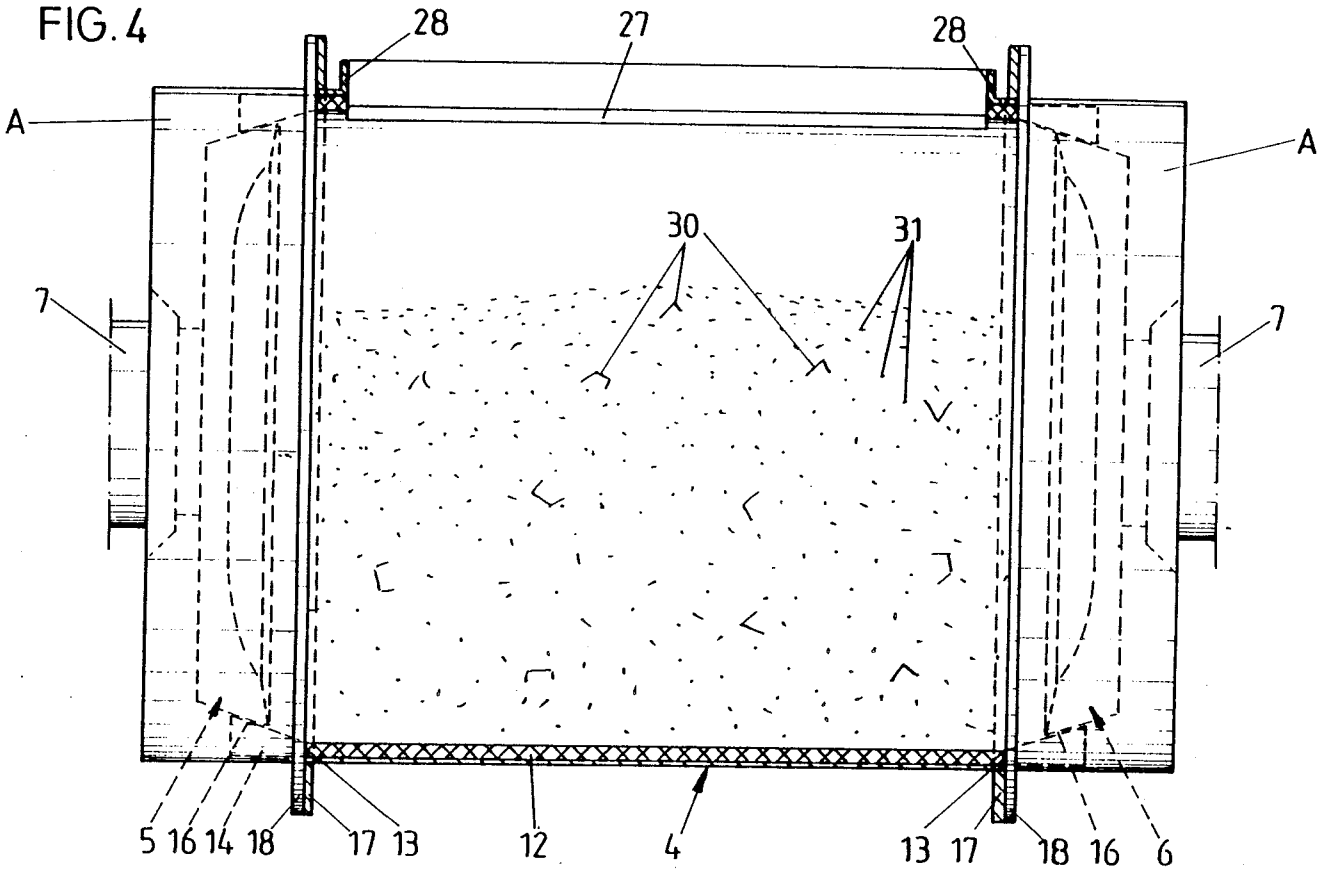
FIG. 4 shows in detail the container mounted for turning around a horizontal axis, with end rotary plates which form the closure walls.
Figure 7:
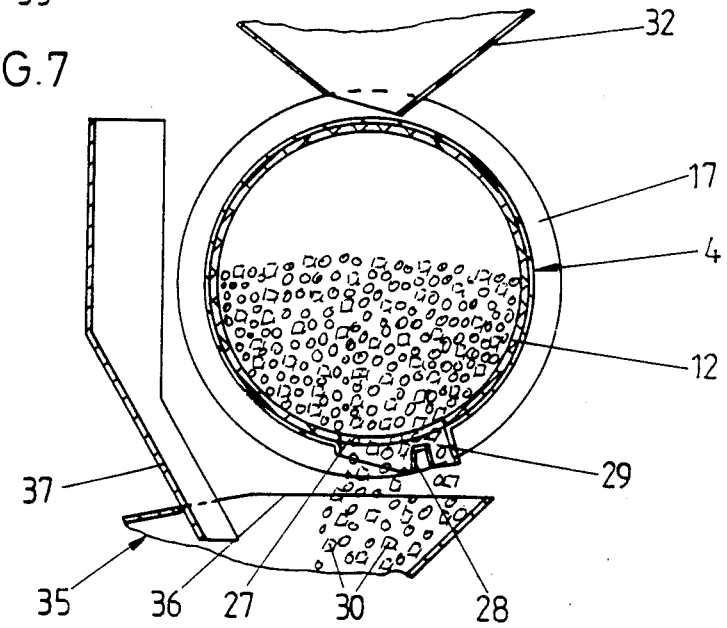
FIG. 7 is a cross-section, corresponding to FIG. 6, in the emptying position of the container.

After filling the container 4, the rotary plates 5, 6 are so driven that they rotate the content of the container, producing an intensive circulatory movement which results in a rapid working of the surface. In addition to a change in the direction of rotation, the speed of the rotary plates relative to each other can also be changed so that different requirements with respect to the working can be taken into account. After completion of the working process, the rotary plates are stopped. This is then followed by turning the container 4 by about 180° in the direction indicated by the arrow X so that the content of the container, as has been mentioned, passes onto the discharge path 38 of the screening device 35. The discharge path 38 is preferably divided into three zones 39, 40, 41. The zone 39 is unperforated. The content of the container falls upon it when the container 4 is brought into the emptying position shown in FIG. 7. The zone 40, which adjoins the zone 39, serves for the passage of water, sludge and undersized particles, and therefore those abrasive members which have become too small as a result of wear. The content of the container then passes over the zone 41, where the abrasive members 31 are separated from the work pieces 30. The abrasive members 31 drop onto a chute 42 and are conducted to the lower end of a return trough 43. As shown in FIG. 2, the content of the container can be subjected to sprays 44 upon passing through the zones 39, 41 of the screening device. Sprays (not shown) can possibly be provided which spray liquid into the container 4 in the emptying position in order to clean the container and accelerate the emptying process.

The work pieces 30 leave the screening path in the direction indicated by the arrow Y. In order to assure their conveyance, the screening device 35 has, associated with it, two vibration generators 45 which produce a component of conveyance in the direction indicated by the arrow Y.

The return trough 43, which is also acted on by a vibratory drive 46, conducts the abrasive members into an abrasive-member container 48 which is supported by a conveyor device 47. Within it there is a compartment for a work-piece container 49. During the screening process, after complete emptying, the container 4 is turned again into its filling or operating position. The corresponding load of work pieces and abrasive members can then be introduced into the container 4 from the storage container 32. After the abrasive members have been introduced into the abrasive-member container 48, they can be moved, together with a loaded work-piece container 49, via the conveyor device 47 into the dashed-line position shown in FIGS. 1 and 2, so that the work pieces and abrasive members pass into the storage container. Since the container 4 effects surface treatment during the operation of the screening device 35 and the filling of the storage container 32, uneconomical standstill times can be reduced to a minimum.

After the loading of the storage container 32, the abrasive-member container 48, together with the work-piece container 49, returns back into the starting position so that the next passage process can take place in the manner described above.

I claim:

1. A centrifugal-force vibratory grinding machine comprising a container held stationary during a grinding operation, the container having a circumferential wall about a central axis with a filling opening on the wall;

a rotary plate mounted rotatably to the container for revolving contents of the container during the grinding operation, the container central axis extending horizontally; and wherein the container has two opposed ends which are closed by two closure walls, said rotary plate serving as one of said closure wall.

2. A centrifugal-force vibratory grinding machine according to claim 1, wherein, the container has a circular cross-section.

3. A centrifugal-force vibratory grinding machine according to claim 1, wherein, in a lower region of its circumferential wall, the container has a closable emptying opening.

4. A centrifugal-force vibratory grinding machine according to claim 1, further comprising a central substantially horizontal shaft; and wherein, the container is mounted for turning around said horizontal shaft in order to fill and empty the container.

5. A centrifugal-force vibratory grinding machine according to claim 1, wherein, the container is rotatably supported to assume its filling or operating position with its filling opening facing upward; and wherein in the container emptying position, the container is so turned that the filling opening faces downward.

6. A centrifugal-force vibratory grinding machine according to claim 1, wherein each of said closure walls is formed as a rotary plate.

7. A centrifugal-force vibratory grinding machine according to claim 6, further comprising means for driving the rotary plates in the same or opposite directions relative to each other.

8. A centrifugal-force vibratory grinding machine according to claim 6, further comprising means for driving the rotary plates with the same or different speeds of rotation.

9. A centrifugal-force vibratory grinding machine according to claim 4, wherein a circumferential edge of the rotary plate extends within the container to form a gap between the container and the plate, the gap extending towards the center of the container and diverging at a slight angle to the shaft of the rotary plate.

10. A centrifugal-force vibratory grinding machine according to claim 1, wherein, as seen in the circumferential direction of the container, a treatment-agent feed opening is arranged adjacent to the filling opening.

11. A centrifugal-force vibratory grinding machine according to claim 1, wherein the filling opening extends substantially over a entire length of the container.

* * * * *